United States Patent [19]

Brettschneider

[11] 4,395,986

[45] Aug. 2, 1983

[54] FUEL INJECTION APPARATUS

[75] Inventor: Johannes Brettschneider, Ludwigsburg, Fed. Rep. of Germany

[73] Assignee: Robert Bosch GmbH, Stuttgart, Fed. Rep. of Germany

[21] Appl. No.: 948,135

[22] Filed: Oct. 3, 1978

[30] Foreign Application Priority Data

Oct. 12, 1977 [DE] Fed. Rep. of Germany ..... 2745844

[51] Int. Cl.[3] ..... F02M 37/00

[52] U.S. Cl. ..... 123/454; 123/455; 251/61.1; 137/469; 137/510

[58] Field of Search ..... 123/139 AW, 452–455; 251/360, 324, 61.1; 137/469, 510

[56] References Cited

U.S. PATENT DOCUMENTS 3,578,019 5/1971 Turolla ..... 251/360
3,853,146 12/1974 Blair ..... 251/324
3,999,528 12/1976 Knapp et al. ..... 123/139 AW

FOREIGN PATENT DOCUMENTS 2006305 8/1971 Fed. Rep. of Germany ..... 123/139 AW

*Primary Examiner*—Charles J. Myhre
*Assistant Examiner*—Magdalen Moy
*Attorney, Agent, or Firm*—Edwin E. Greigg

[57] ABSTRACT

A fuel injection apparatus is proposed for internal combustion engines with distributor and apportionment valves, which serves to apportion a quantity of fuel proportional to the induced air quantity. The distributor and apportionment valves of the fuel injection apparatus comprise a slide valve which is displaceable opposite a slotted bushing fixed in the valve housing and equipped with slots, in order to effect the variation of the current flow area of the apportionment valves. A control sleeve is interposed between the slotted bushing and the control slide and includes a portion which partially covers the control slots in the bushing to provide for fine control of the control slots in the bushing.

3 Claims, 2 Drawing Figures

FUEL INJECTION APPARATUS

BACKGROUND OF THE INVENTION

The present invention relates to a diaphragm valve with a valve plate which operates together with a valve seat and with a flexible diaphragm formed as a movable valve which separates a housing into two chambers. A fuel injection apparatus for mixture-compressing, externally ignited internal combustion engines with distributor and apportionment valves is already known. In this type of known valve, as a result of the differences in height of the control slits dictated by technical considerations during manufacture, the fuel quantities apportioned to the individual cylinders vary greatly and thus create an undesirable condition. It has been found that the variation in apportioned fuel quantities is particularly great in the idling range, so that there are difficulties associated with the idling adjustment of the motor vehicle engine.

OBJECT AND SUMMARY OF THE INVENTION

The fuel injection apparatus for internal combustion engines with distributor and apportionment valves according to the present invention has the advantage over the earlier devices that manufacturing tolerances in the height of the control slits overlap and thus differences in the fuel apportionment are avoided.

A further advantage of the present invention over the prior art structures is the simplification of the manufacturing process to produce an extremely satisfactory diaphragm valve.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
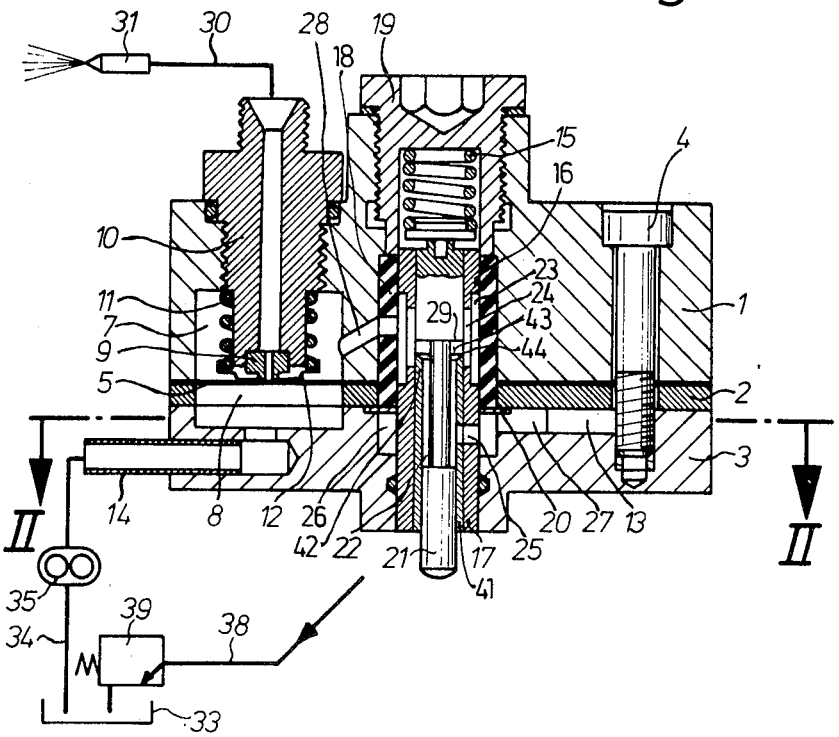
FIG. 1 is a lengthwise section along the lines I—I of FIG. 2.
Figure 2:
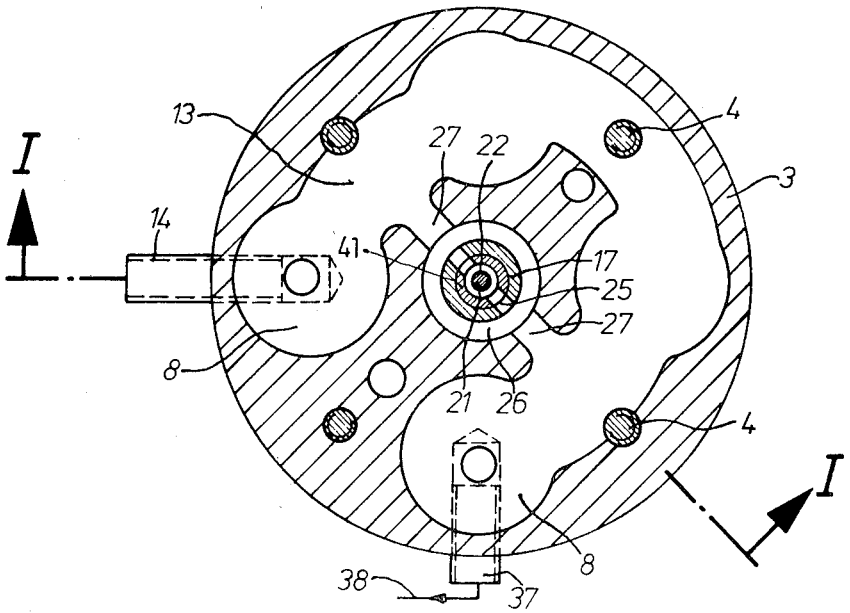
FIG. 2 is a cross section along the lines II—II of FIG. 1.

In the fuel injection apparatus with distributor and apportionment valves according to FIGS. 1 and 2, a valve housing 1, an intermediate plate 2 and a bottom cover plate 3 are axially joined by screws 4. A valve diaphragm 5 is inserted between the valve housing 1 and intermediate plate 2. In the area of axial bores which are equidistantly distributed about the housing axis, the valve diaphragm 5 serves as the diaphragm of diaphragm valves, separating the axial bores into chambers 7 and 8. This exemplary embodiment concerns a distributor apparatus for a four-cylinder engine, that is, one having four diaphragm valves. In each of these valves the diaphragm forms a flat seat valve together with a rigid valve seat 9 arranged in the same plane as the diaphragm insertion. The valve seat 9 is encompassed in a valve seat carrier 10, which is screwed into the valve housing 1 and serves as the connector for the lines 30, which lead to the injection valves 31; only one each of the lines and injection valves is shown. A helical spring 11 with as shallow a characteristic curve as possible is supported on the valve seat carrier 10. This helical spring 11 urges the membranes in the opening direction via a spring plate 12, so that the diaphragm valve which is not in use is opened.

The sections of the chambers 8 located in the bottom cover plate 3 are connected with each other by an annular channel 13 which provides for communication between those chambers so that a fluid current can flow from the first chamber to the second and then to the third and the fourth, but not, however, directly from the first to the fourth. A fuel line 34 extends from a fuel container 33 through a continuous-feed fuel pump 35 and a nipple 14 to the first chamber 8. From the fourth chamber 8 a fuel line 38 extends through a nipple 37 to a pressure maintenance valve 39 and from there back to the fuel container 33.

There is a slotted bushing 17 arranged in an axial bore 16 which penetrates the entire distributor apparatus. This slotted bushing 17 is secured against longitudinal and rotary movement by an elastic sealing bushing 18 (which can be made of rubber), to this end the slotted bushing 17 is axially pressed by a threaded plug 19 against a disc 20 which is supported between bottom cover 3 and intermediate plate 2. This construction thus prevents any inadvertent leakage between the respective elements comprising the assembly.

A slide valve 21, which has an annular groove 22, slides axially in the slotted bushing 17 against the force of the spring 15 that is received in a blind bore in the plug 19. Vertical grooves 23 are located in the slotted bushing 17 which communicate with the inner bore of the bushing by means of vertical grooves or slots 24 which are all axially exactly parallel to each other. Depending on the position of the slide valve 21 with its control edge 29, the slide valve 21 opens a greater or lesser length of the control slots 24. Radial bores 25 are also disposed in the slotted bushing, to provide a continuous communication between the annular groove 22 and an annular channel 26 arranged in the bottom cover plate 3 and defined by the intermediate plate 2 and the sealing bushing 18 together with the slotted bushing 17. From the annular channel 26, radially extending channels 27 (FIG. 2) lead to the channel 13, so that the channel 26 communicates with the chambers 8 of the diaphragm control valves. The vertical grooves 23 disposed in the slotted bushing 17 communicate via channels 28 with the chamber 7 of the diaphragm control valves, so that each control valve has one vertical groove 23 with its control slot 24. It is to be understood that the chambers 7 of these control valves are separated from each other.

A control sleeve 41 is pressed into the slotted bushing 17 and partially overlaps the control slots 24 with its end 42 facing the control edge 29 of the slide valve 21. The front edge 43 of the end 42 of the control sleeve 41 partially overlapping the control slots 24 is perpendicular to the axis of symmetry of the control sleeve 41. The outer surface 44 of the end 42 of the control sleeve 41 facing the control slots 24 can be chamfered, as shown, for example it may include an inner beveled area. By means of the overlapping of the lower end of the control slots 24 shown in the drawing by the end 42 of the control sleeve 41, flowthrough cross sections are produced opposite the control edge 29 of the slide valve 21 each having the same length, so that equal quantities of fuel can be apportioned to the individual cylinders of the internal combustion engine. The slide valve 21 can be embodied in the manner illustrated, so that it glides in the control sleeve 41 with a section of smaller diameter and also has a section of larger diameter which, gliding in the slotted bushing 17, determines with its control edge the length of the apportionment cross section which is opened.

The mode of operation of the above-described device is as follows:

Fuel flows from the fuel container 33 through the line 34, the continuous-feed fuel pump 35, and the nipple 14 into one of the chambers 8 of the slide valves and flows from there through the channel 13 to the other chambers 8 of the other slide valves, the unused portion returning to the fuel container 33 by way of the nipple 37, the line 38 and the pressure maintenance valve 39, which determines the pressure in the distributor system. By means of these through currents, the inclusion of air bubbles which may collect underneath the diaphragms is substantially prevented. The remaining portion of the fuel flows through the channels 27, which are sufficiently long to effect a diminution of disturbances in the fuel which travels to the annular channel 26. Part of the fuel flows from this annular channel 26 through the radial bores 25 into the annular groove 22 of the slide valve. From the annular groove 22 the fuel flows through the control slots 24 in apportioned amounts into the vertical grooves 23 and from there via the channel 28 into the chambers 7 of the slide valves.

The rigidity of the diaphragm and the force of the spring 11 are chosen so that when the pressure changes between the two chambers 7 and 8 of the slide valves, the diaphragm valve also changes relative to the current flow area between the diaphragm and the valve seat until the desired pressure has been re-established. By means of the flat seat valve embodied according to the invention this is accomplished in an extraordinarily short time, because even a small stroke of the diaphragms changes the current flow area to a large degree. The small diaphragm stroke causes force of the spring, on the contrary, to change only slightly, so that the regulation can continue very precisely. The pressure gradient at the apportionment valves 21, 24 is thus independent of the quantities flowing therethrough.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection apparatus for internal combustion engines, the apparatus including: a housing, a plurality of fuel distributor valves mounted to the housing; and an equal plurality of fuel apportionment valves mounted within the housing, the fuel distributor valves and fuel apportionment valves together determining the fuel quantity flowing from the fuel injection apparatus, said apportionment valves being defined by a bushing fixedly mounted within the housing and a slide valve, the slide valve defining a control edge, the bushing defining a plurality of slots, equal to the number of distributor valves, and a surface defining a bore within which the slide valve is displaceable into varying communication, with its control edge, with the plurality of slots such that the opening cross section of each slot is variable as a function of the displacement of the slide view, the improving comprising:

a control sleeve pressed into the bore of the bushing between the surface defining the bore and the slide valve, the control sleeve extending within the bore of the bushing with one end adjacent to the control edge of the slide valve and partially overlapping the plurality of slots defined by the bushing.

2. The improved fuel injection apparatus as defined in claim 1, wherein the end of the control sleeve which is adjacent to the control edge of the slide valve and partially overlaps the plurality of slots defines an edge which lies in a plane situated perpendicular to the longitudinal axis of the control sleeve.

3. The improved fuel injection apparatus as defined in claim 2, wherein the end of the control sleeve which is adjacent to the control edge of the slide valve and partially overlaps the plurality of slots defines a surface which is chamfered inwardly toward the slide valve.

* * * * *